US012698112B2

(12) United States Patent
Soria et al.

(10) Patent No.: US 12,698,112 B2
(45) Date of Patent: Aug. 4, 2026

(54) LAMINAR GASSING RAIL FOR FOOD PACKAGING

(71) Applicant: Excel Packaging Consulting, LLC, Big Rock, IL (US)

(72) Inventors: Francisco J. Soria, Big Rock, IL (US); Koon H. Wong, Deerfield, IL (US)

( * ) Notice: Subject to any disclaimer, the term of this patent is extended or adjusted under 35 U.S.C. 154(b) by 88 days.

(21) Appl. No.: 18/926,637

(22) Filed: Oct. 25, 2024

(65) Prior Publication Data

US 2026/0116598 A1 Apr. 30, 2026

(51) Int. Cl.
*B65B 31/00* (2006.01)

(52) U.S. Cl.
CPC ..... *B65B 31/00* (2013.01)

(58) Field of Classification Search
CPC ..... B65B 31/00
USPC ..... 53/405, 432; 141/65
See application file for complete search history.

(56) References Cited

U.S. PATENT DOCUMENTS 5,816,024 A 10/1998 Sanfilippo et al.
5,911,249 A * 6/1999 Sanfilippo ..... B67C 3/222 141/70
6,032,438 A * 3/2000 Sanfilippo ..... B65B 31/00 141/70

FOREIGN PATENT DOCUMENTS

GB 2632366 A 2/2025

OTHER PUBLICATIONS

UK Intellectual Property Office, Patent Search Report of GB2504110.4; Jul. 29, 2025; United Kingdom.

* cited by examiner

*Primary Examiner* — Timothy L Maust
(74) *Attorney, Agent, or Firm* — IpHorgan Ltd.

(57) ABSTRACT

A gassing rail apparatus to be used in a food packaging conveyor system. A rail top assembly including a rail top, a gas port coupled to the laminar flow port opening, a three layer element, the three layer element is received by the lower portion of the rail top, and a rail frame which extends along a longitudinal axis, The gassing rail apparatus further includes a rail bottom located below the top rail. The rail bottom adapted to receive at least one rail top assembly. The rail bottom having at least one gas distribution opening corresponding to each rail top assembly. The gas distribution opening receives a corresponding downward depending flange and aligns the rail top assembly and rail bottom. A stainless steel embodiment is also provided. The present invention also provides a rail bride mounting assembly adapted to be used with the gassing rail apparatus.

14 Claims, 18 Drawing Sheets

LAMINAR GASSING RAIL FOR FOOD PACKAGING

FIELD OF THE INVENTION

The present invention relates to laminar gassing rail assembly for flushing gas during packaging process.

BACKGROUND OF THE INVENTION

The prior art includes a system and process of packaging food items. U.S. Pat. No. 6,032,438 is directed to a controlled environment gassing system for removing the existing environment from containers. U.S. Pat. No. 10,934,036 is directed to an apparatus and method for distributing a flushing gas. U.S. Pat. No. 5,911,249 discloses a gassing rail apparatus and method.

The prior art all provide laminar flow gassing rails. However, the prior art requires two long O-ring cords to seal the rail top against the rail bottom. The prior art includes two long elements consisting of a baffle and two layer element, which are very flimsy. Both items may be damages easily and require regular replacement. In addition, the gas distribution is not uniform. Rather, there is a higher concentration at the center part of the top rail.

In addition, to clean the prior art gassing rail, it is necessary to remove the rail top and rail bottom from the production line, requiring additional down time.

Additionally, numerous clamps are required to clamp the rail bottom to the rail top assembly in a sealing engagement.

There is a need to reduce the period for maintenance, as well as reduce the maintenance time, and provide a uniform gas distribution. In addition, it is desirable for provide such a system with reduced complexity and parts, and to improve efficiency.

SUMMARY OF THE INVENTION

The present invention provides a gassing rail apparatus to be used in a food packaging conveyor system. The gassing rail apparatus adapted to be coupled to a gas source and includes a rail top assembly. The rail top assembly including a rail top. The rail top having an upper portion with at least one laminar flow port opening, and a lower portion includes a laminar flow channel, the laminar flow channel extends generally along a longitudinally axis, the laminar flow port opening coupled to the laminar flow channel, the longitudinal laminar flow channel is surrounded by an outer seat, the outer seat having a generally rectangular shape, a gas port coupled to the laminar flow port opening, the gas port is adapted for coupling to a gas source, a three layer element having a planar shape which extends generally along a longitudinally axis, the three layer element has an upper surface and a lower surface, the three layer element is received by the lower portion of the rail top, and a rail frame which extends along a longitudinal axis, the rail frame has an upper surface and a lower surface, at least one gas distribution slot extending along a longitudinal axis, the rail frame substantially planar with a downward depending flange extending from the at least one gas distribution slot, the rail frame is received by the outer seat. The gassing rail apparatus further includes a rail bottom located below the top rail. The rail bottom adapted to receive at least one rail top assembly. The rail bottom having at least one gas distribution opening corresponding to each rail top assembly. The at least one gas distribution opening extending along the longitudinal axis of the rail bottom, and is aligned with the laminar flow channel. The gas distribution opening receives a corresponding downward depending flange and aligns the rail top assembly and rail bottom. A stainless steel embodiment is also provided.

The present invention also provides a rail bride mounting assembly adapted to be used with the gassing rail apparatus.

DETAILED DESCRIPTION OF THE INVENTION

Figure 1:
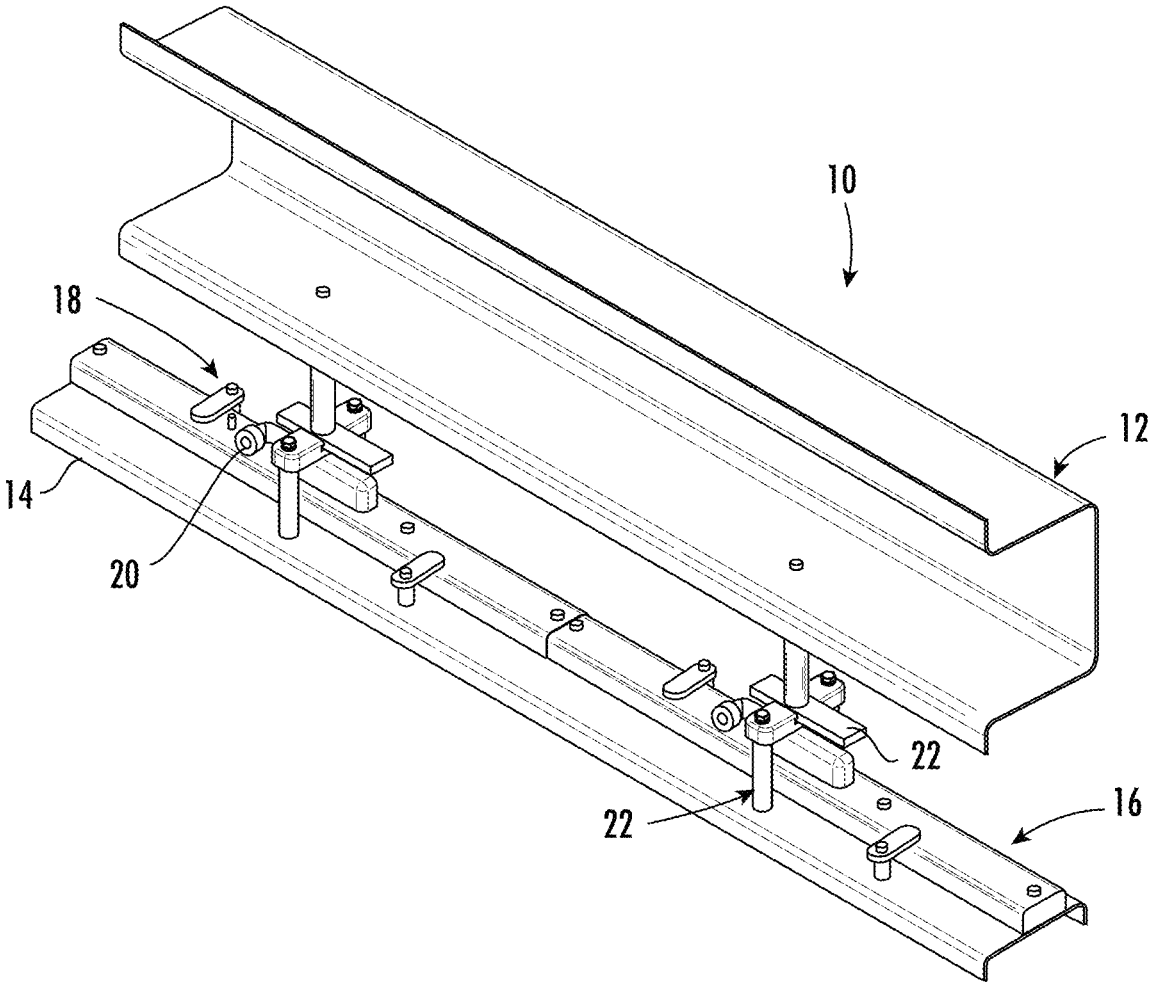
FIG. 1 is a perspective view of a gassing rail assembly supported by a C-channel in accordance with a first embodiment of the present invention.

FIG. 1 is a perspective view of a gassing rail assembly 10 supported by a C-channel 12 in accordance with a first embodiment of the present invention. The gassing rail assembly 10 includes a rail base or bottom 14, upon which is two rail top or manifold assemblies 16 mounted end-to-end. Each rail top assembly 16 is secured to the rail bottom 14 via a plurality of rotating locking arms 18. A gas attachment 20 for laminar flow is coupled to the rail top assembly 16. An inverted U-shaped mount 22 is secured to the rail top assembly 16. A mounting structure 24 is secured between the C-channel 12 and the inverted U-shaped mount 22. A first hose (not shown) is used to couple a first gas source (not shown) to the laminar gas attachment 20. As is known in the art, the gas source is adapted for providing an inert gas, such as nitrogen, having a laminar flow. The mounting structure 24 may be used to stabilize and secure the gas hose.

Figure 2:
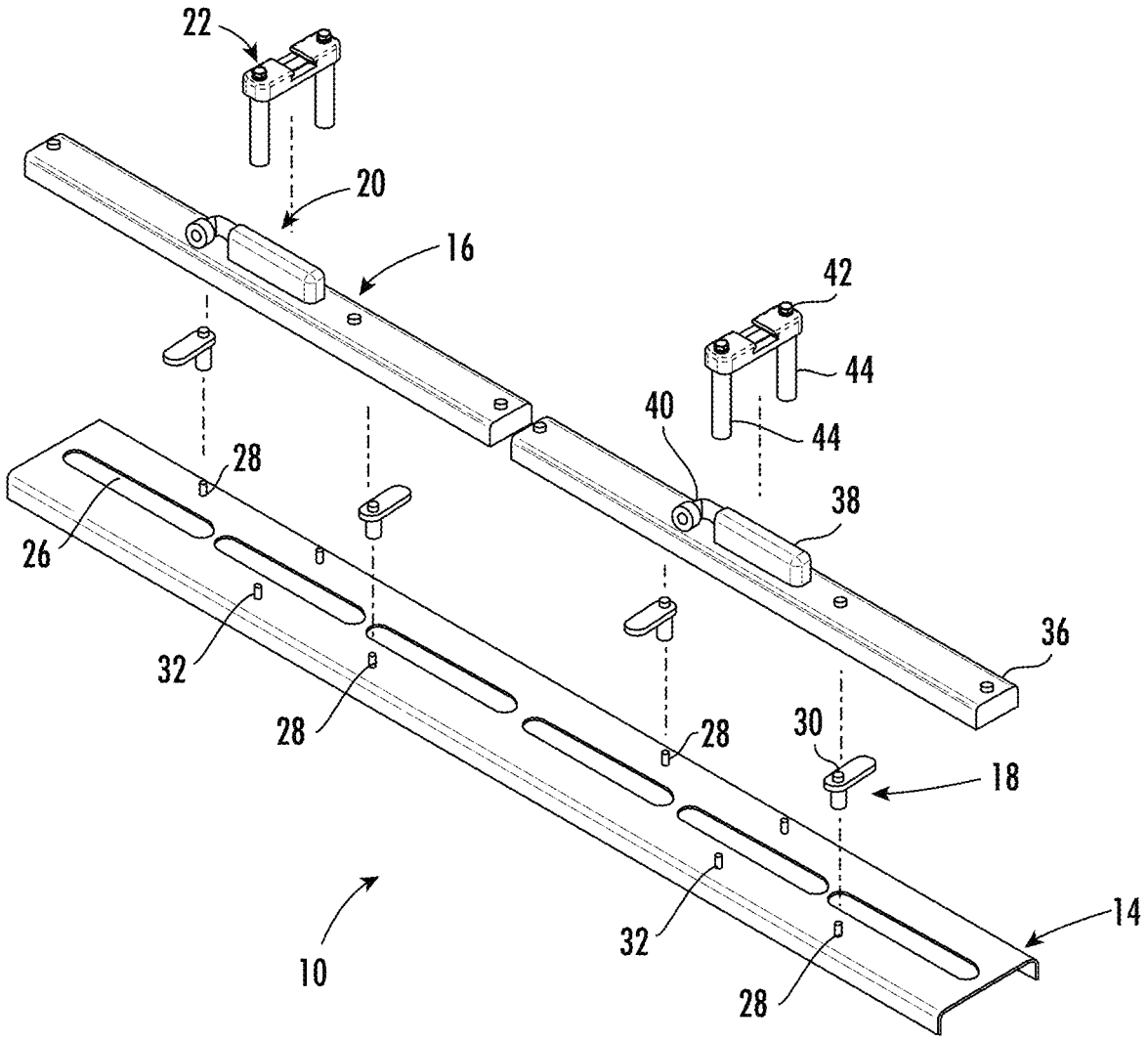
FIG. 2 is a partial exploded view of the gassing rail assembly of FIG. 1.

FIG. 2 is partial exploded view of the gassing rail assembly of FIG. 1. It can be seen that the rail bottom 14 includes three slots or gas distribution openings 26 corresponding to each rail top assembly 16. The three slots 26 are aligned end-to-end. Four studs 28 are shown secured to the rail bottom 14 via welding or other means. The studs 28 include threaded upper openings to receive a respective fastener or screw 30 for securing a respective rotating locking arm 18. Four threaded fasteners 32 are shown extending from the upper surface of the rail bottom 14 through respective openings in the rail bottom 14. The four threaded fasteners 32 are for securing the inverted U-shaped mounts 22 to the rail bottom 14. Four nuts 36 are shown on the top surface of each rail top assembly 16. The laminar flow gas attachment 20 includes a port block 38 and a port fitting 40. The inverted U-shaped mount 22 includes a bridge portion 42 and a pair of standoffs 44.

Figure 3:
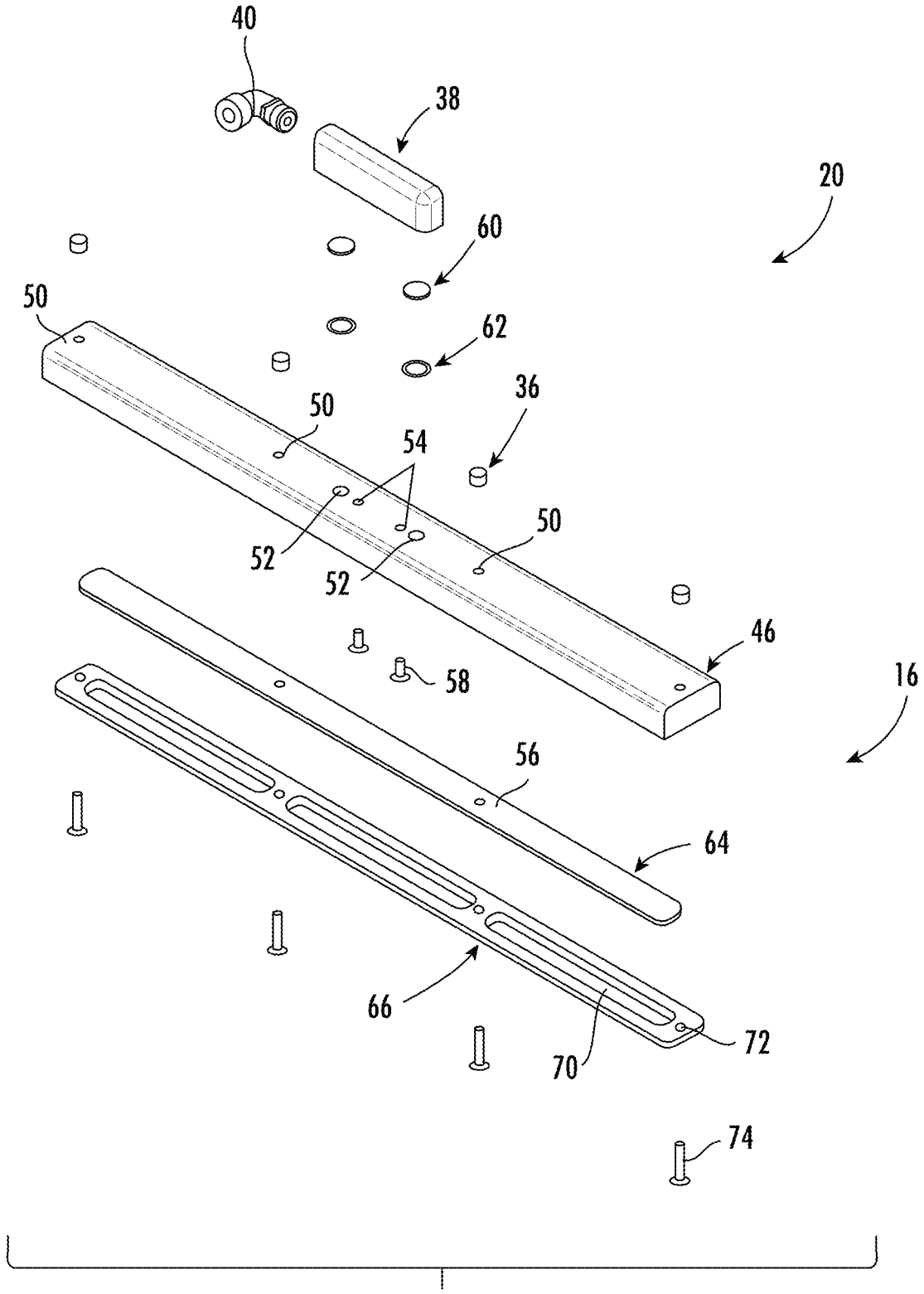
FIG. 3 is a partial exploded view of the rail top assembly and port block of FIG. 1.

FIG. 3 is a partial exploded view of the rail top assembly 16 and gas port 20 of FIG. 1. The rail top 46 may be made of plastic and includes the top surface 48 having four through holes 50, and two laminar port flow openings 52 with corresponding through holes 54 for securing the port block 38 via two fasteners 58. Two port block baffles 60 are located above corresponding O-rings 62. The three layer element 64 is shown to include two through holes 56 which correspond to two of the four through holes 50 in the rail top 46. The rail frame 66 is shown to include three slots or gas distribution openings 70 and four through holes 72 which correspond to the four through holes 50 in the rail top 46.

Figure 4A:
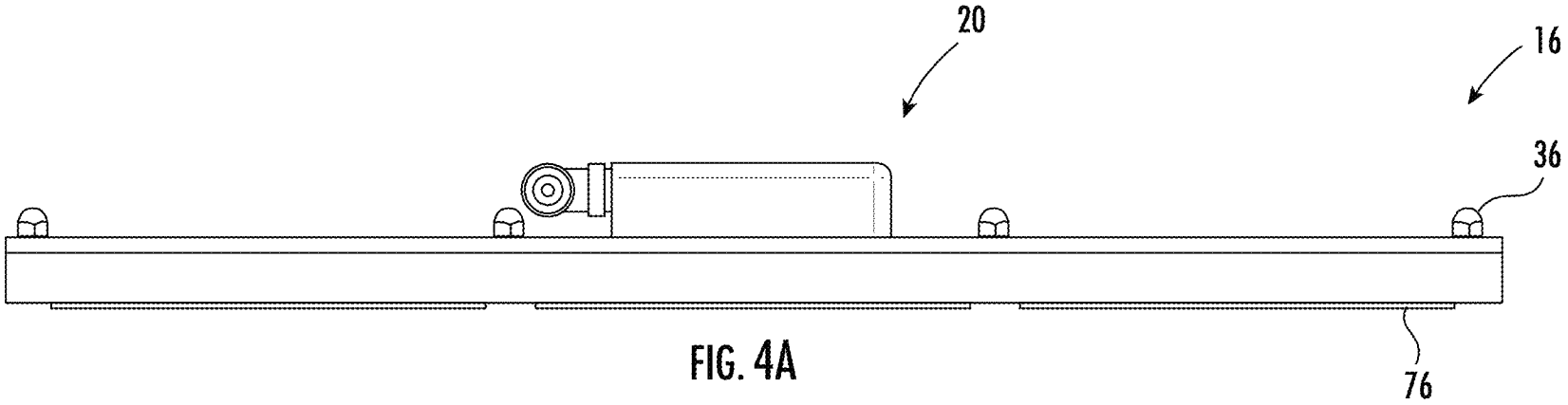
FIG. 4A is a side view and FIG. 4B is a bottom view of the rail top assembly and port block of FIG. 1.
Figure 4B:
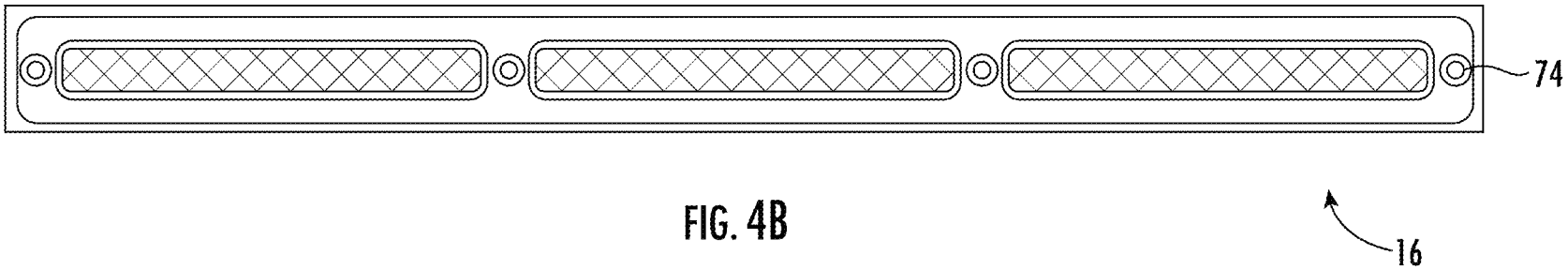

FIG. 4A is a side view and FIG. 4B is a bottom view of the rail top assembly 16 and gas port 20 of FIG. 1. The four fasteners 74 are shown which extend through the rail frame 66, three layer element 64 and rail top 46, and are secured via the nuts 36. Each of the three slots or gas distribution openings 70 of the rail frame 66 is shown to include downward depending flange 76.

Figure 5:
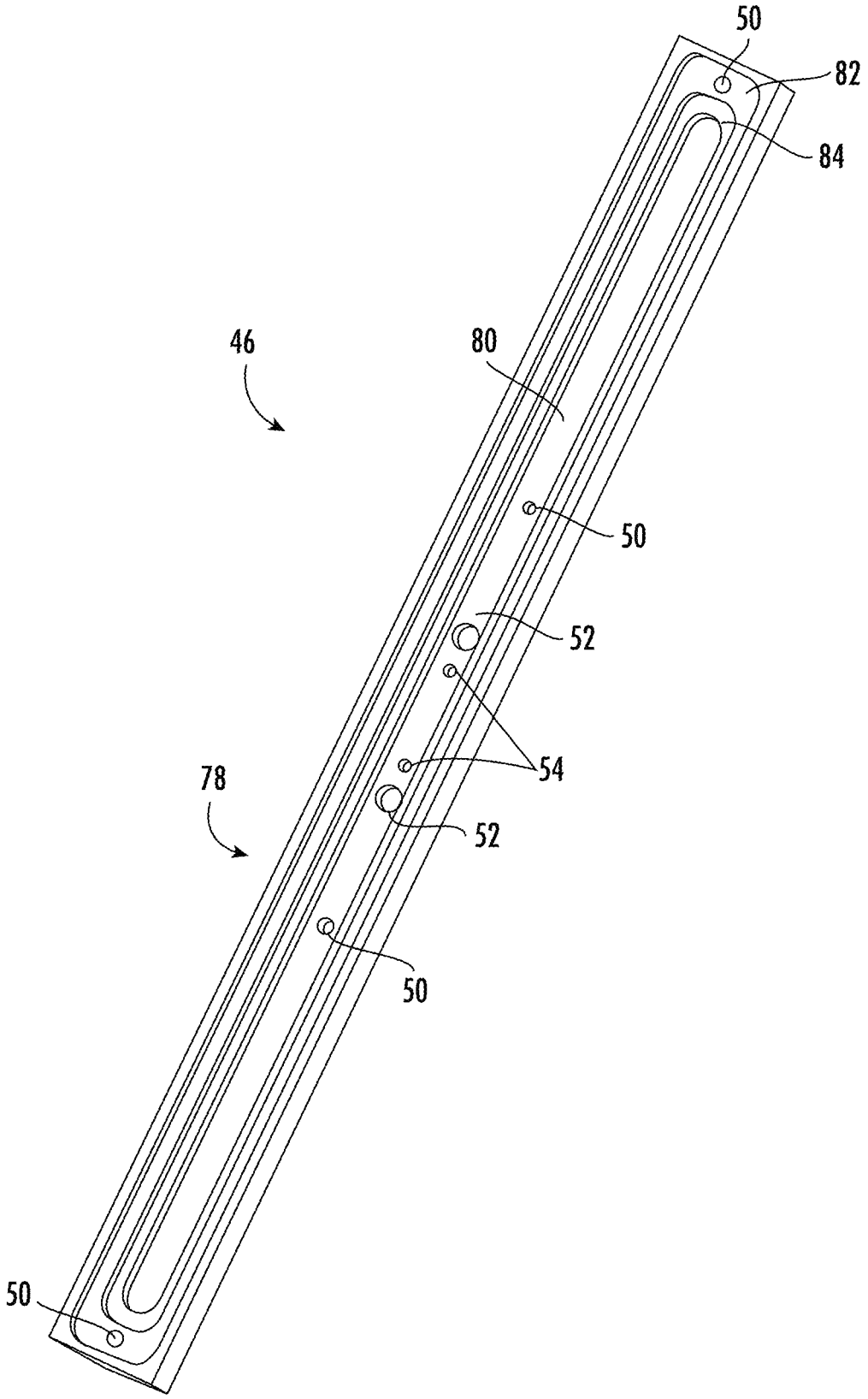
FIG. 5 shows a perspective bottom view of the rail top of FIG. 1.

FIG. 5 shows a perspective bottom view of the rail top 46 of FIG. 1. The rail top 46 includes a lower portion 78 having a laminar flow channel 80. The laminar flow channel 80 extends generally along a longitudinally axis. The laminar flow port opening 52 is coupled to the laminar flow channel 80. The longitudinal laminar flow channel 80 is surrounded by an outer seat 82, the outer seat having a generally rectangular shape. The rail top includes an inner seat 84 located between the longitudinal laminar flow channel 80 and the outer seat 82, the inner seat 84 having a generally rectangular shape, wherein the three layer element 64 is received by the inner seat 84. The rail frame 66 is received by the outer seat 82.

Figure 6A:
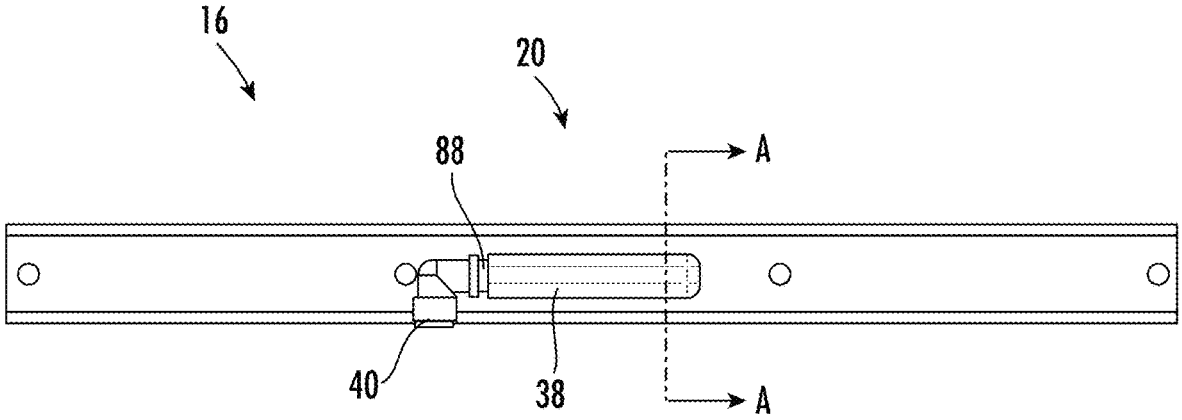
FIG. 6A is a top view of the rail top assembly of FIG. 1
Figure 6B:
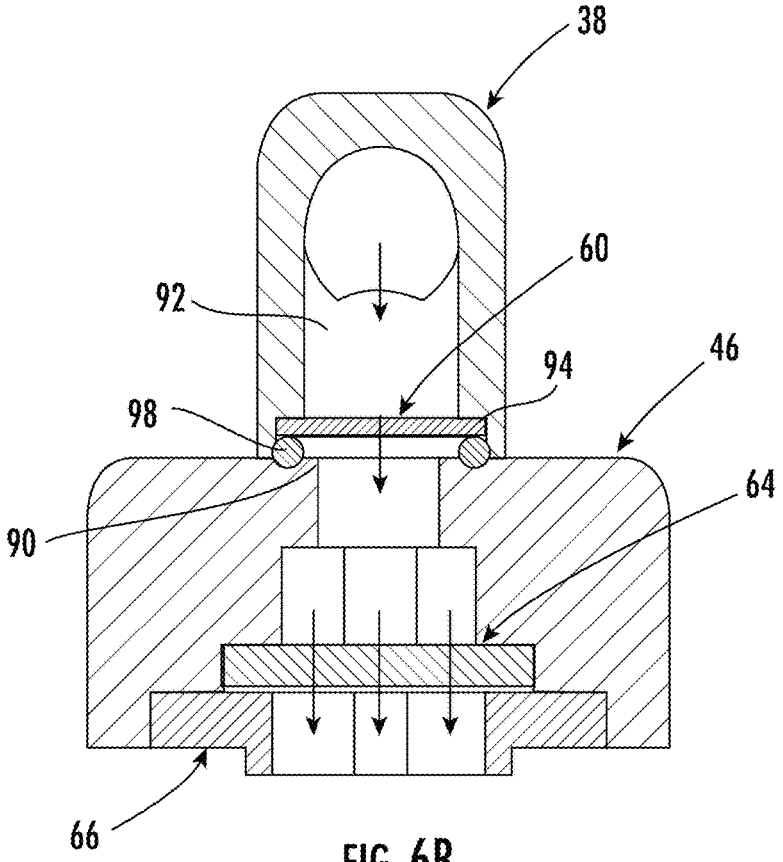
FIG. 6B is a cross sectional view taken along line A-A of FIG. 6A.

FIG. 6A is a top view of the rail top assembly of FIG. 1 and FIG. 6B is a cross sectional view taken along line A-A of FIG. 6A. The gas port 20 includes a port block 38 having a port fitting opening 88 and a first and second port block outlets 90, the port block 38 having a channel 92 in fluid communication with the port fitting opening 88 and the first and second port block outlets 90, wherein each of the port block outlets 90 includes a recessed seat 94 to receive a respective port block baffle 60 and an O-ring 62 located below the port block baffle 60, and the port block 38 is secured to the upper portion 48 of the rail top 46 with the first and second port block openings 90 aligned with a respective first and second laminar flow port openings 52, and the a port fitting opening 88 receives a port fitting 40.

Figure 7:
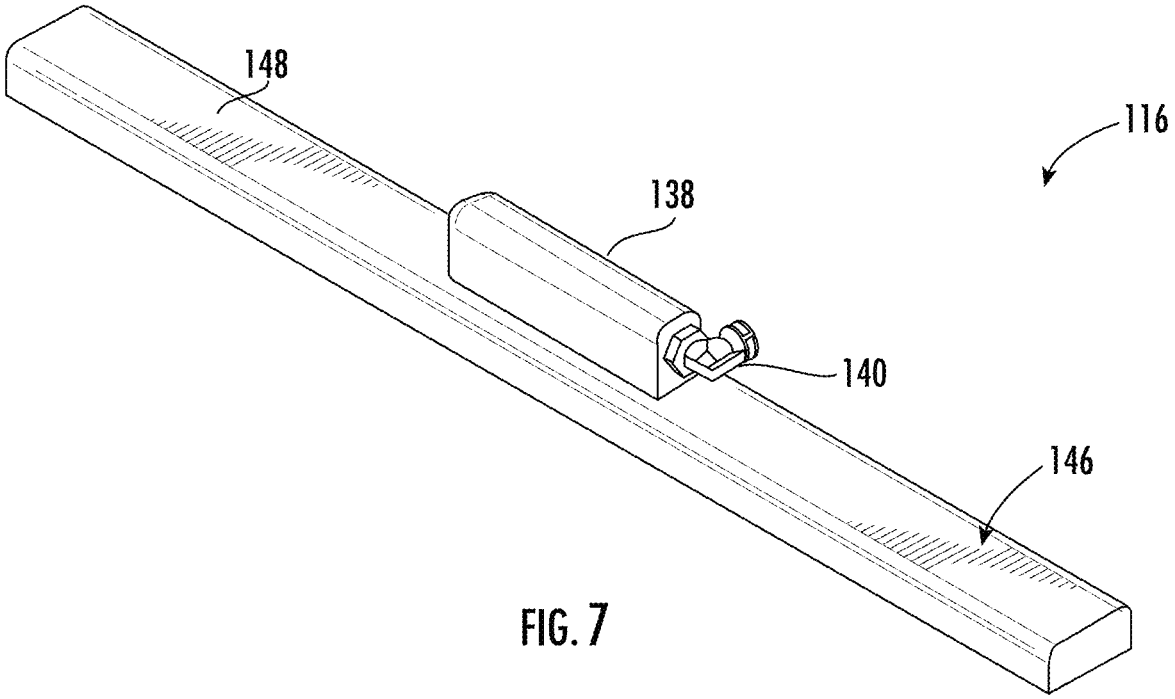
FIG. 7 is a perspective view of a rail top assembly of a gassing rail assembly in accordance with a second embodiment of the present invention.
Figure 8:
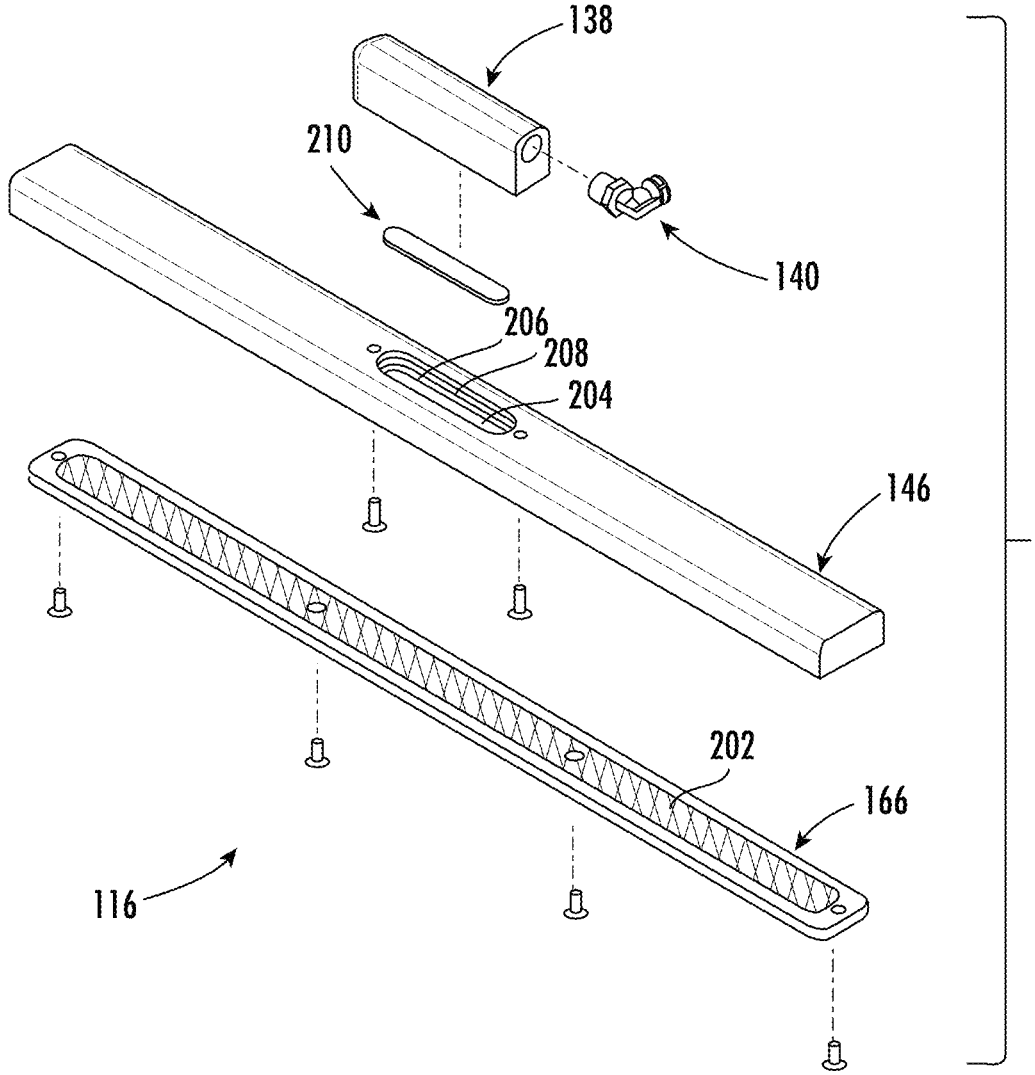
FIG. 8 shows a partial exploded view of the rail top assembly of FIG. 7.
Figure 9A:
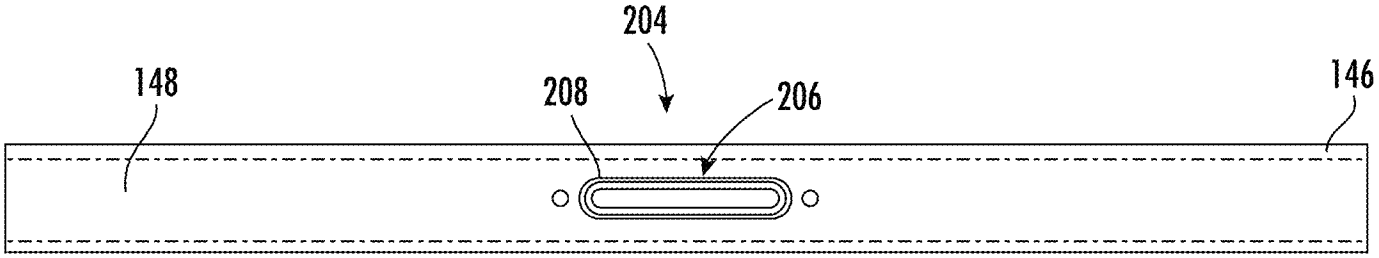
FIG. 9A shows a top view, FIG. 9B a side view and FIG. 9C a bottom view of the rail top of FIG. 7.
Figure 9B:
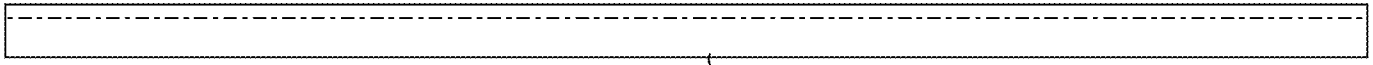
Figure 9C:
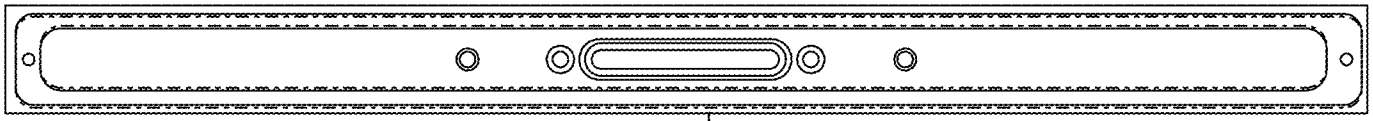
Figure 10A:
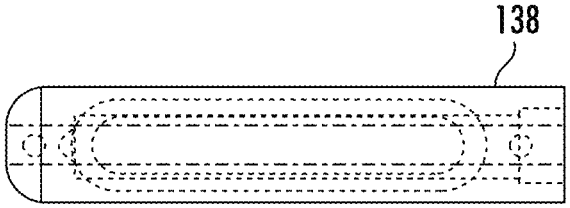
FIG. 10A shows a top view, FIG. 10B a side view, FIG. 10C a bottom view and FIG. 10D an end view of the port block of FIG. 7.
Figure 10B:
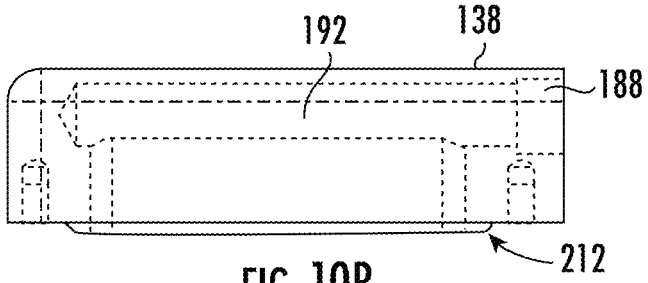
Figure 10C:
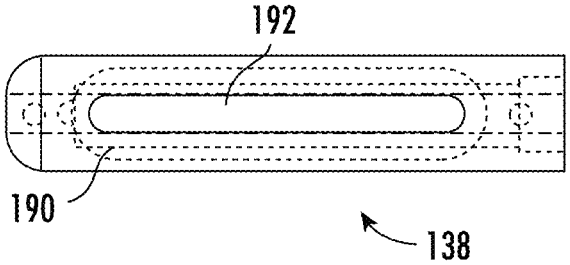
Figure 10D:
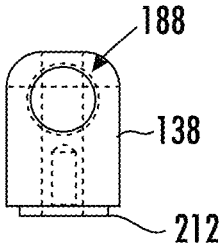

FIG. 7 is a perspective view of a rail top assembly 116 of a gassing rail assembly 110 in accordance with a second embodiment of the present invention. In this embodiment, the rail bottom 114 of FIG. 1 may be made of stainless steel. In addition, the rail top 146, the port block 138 and rail frame 166 are made of stainless steel. The rail top 146 includes a smooth surface 148 to prevent buildup of powder. FIG. 8 shows a partial exploded view of the rail top assembly 116 of FIG. 7. FIG. 9A shows a top view, FIG. 9B a side view and FIG. 9C a bottom view of the rail top 146 of FIG. 7. FIG. 10A shows a top view, FIG. 10B a side view, FIG. 10C a bottom view and FIG. 10D an end view of the port block 138 of FIG. 7. The upper surface of the rail frame 166 includes a recessed seat 200 for receiving the three layer element 202, The rail frame 166 and three layer element 202 are welded together. The upper portion of the rail top 146 includes a laminar flow port opening 204 have an oval shape, wherein the oval shaped laminar flow port opening 204 forms an inner recessed seat 206 and an outer recessed seat 208. A single layer oval shaped baffle 210 is received by the inner recessed seat 206. The gas port 120 includes a port block 138 having a port fitting opening 188 and an oval shaped port block outlet 190. The port block 138 having a channel 192 in fluid communication with the port fitting opening 188 and the oval shaped port block outlet 190, wherein the oval shaped port block outlet 190 includes a downward extending step 212 which is received by the outer recessed seat 208 of the rail top 146. The port block 138 is secured to the upper portion 148 of the rail top 146 with the oval shaped port block outlet 190 aligned with the oval shaped laminar flow port opening 204. The single layer oval shaped baffle 210 is in direct contact with the inner seat 206 of the rail top 146 and the downward extending step 212 of the port block 138, and the port fitting opening 188 receives a port fitting 140.

Figure 11A:
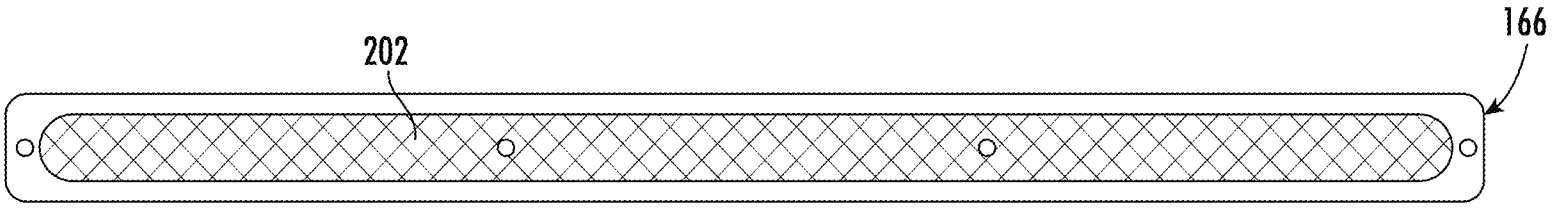
FIG. 11A is a top view, FIG. 11B a side view
Figure 11B:
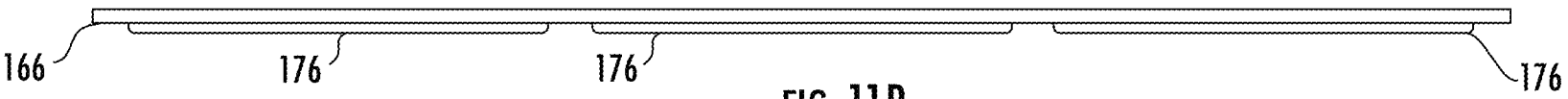
FIG. 11C is a bottom view of a three layer element and an element holder of FIG. 7.
Figure 11C:
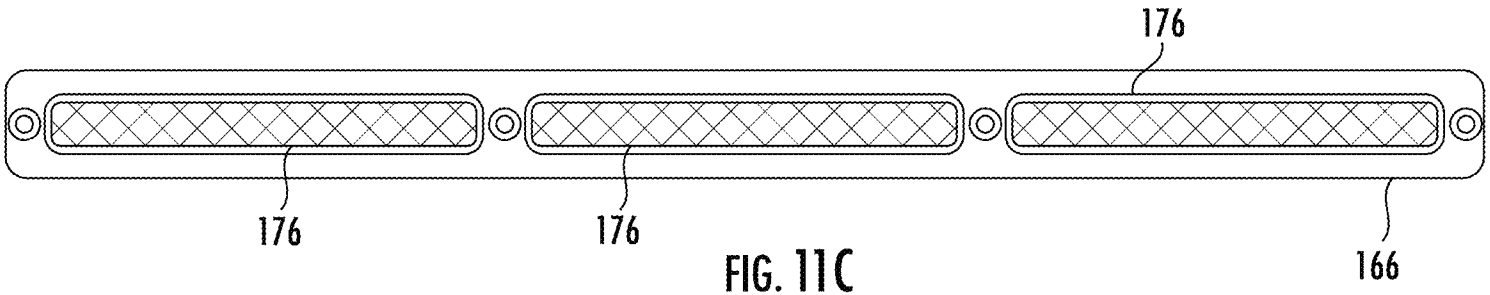
Figure 12:
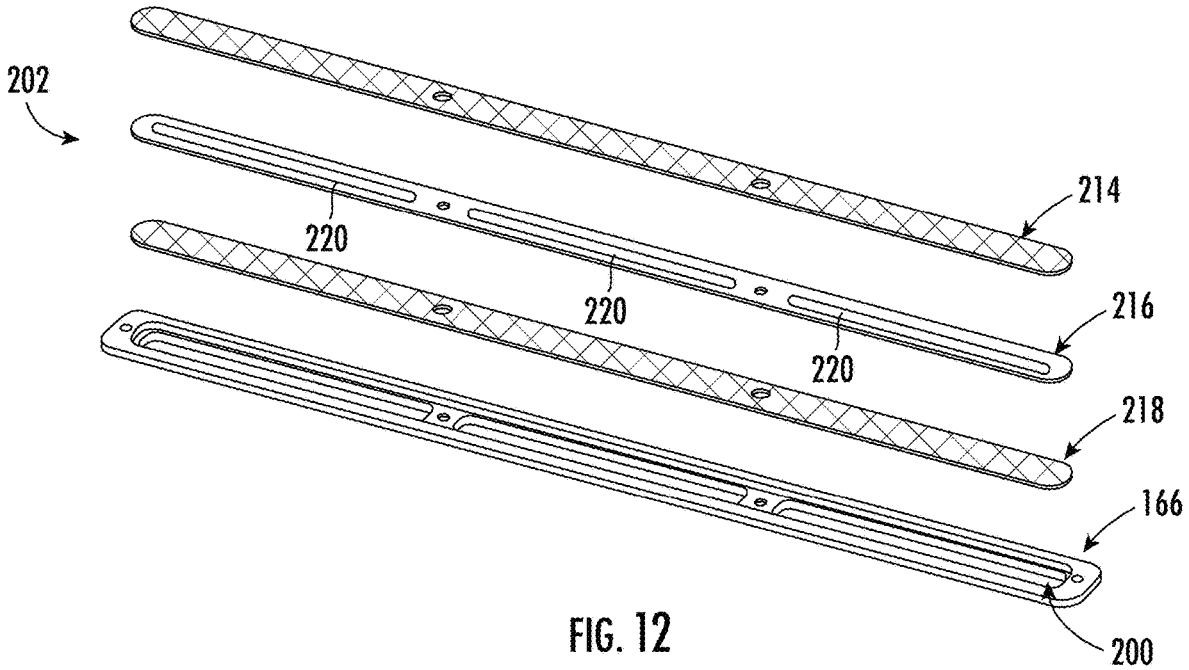
FIG. 12 is an exploded view of the three layer element and an element holder of FIG. 7.

FIG. 11A is a top view, FIG. 11B a side view and FIG. 11C is a bottom view of a three layer element 202 and an element holder 166 of FIG. 8. FIG. 12 is an exploded view of the three layer element 202 and an element holder 166 of FIG. 8. The three layer element 202 comprises a top layer 214, middle layer 216 and bottom layer 218. The top layer 214 is a 5-ply element, the middle layer 216 is a 5-ply element having three gas distribution opening 220, and the bottom layer 218 is a 2-ply element.

Figure 13:
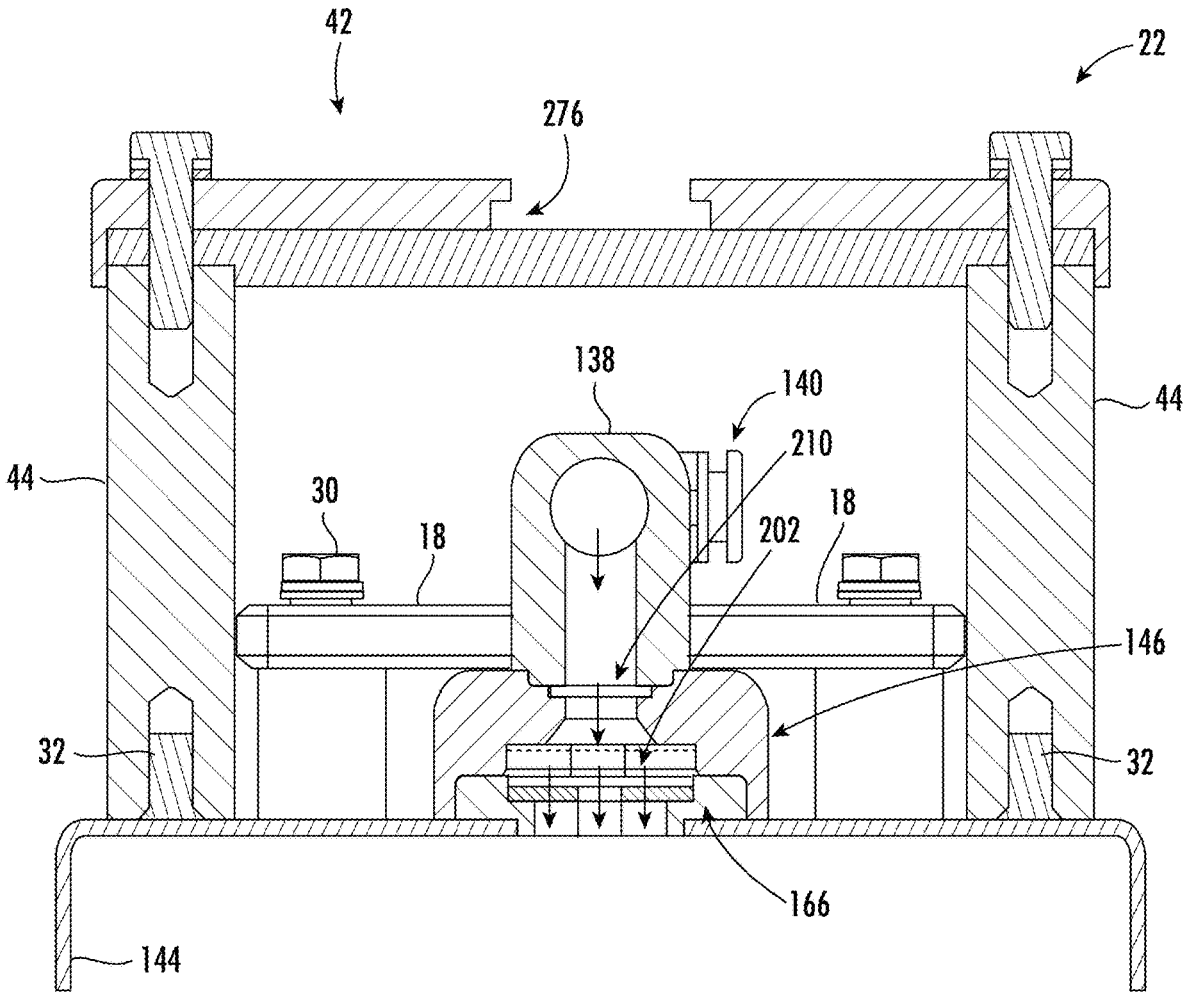
FIG. 13 is a cross section of the gassing rail assembly of FIG. 1 taken through the rail bridge, with the C-channel and mounting fixture omitted, and the rail bottom and rail top assembly modified per the embodiment of FIG. 7.
Figure 14:
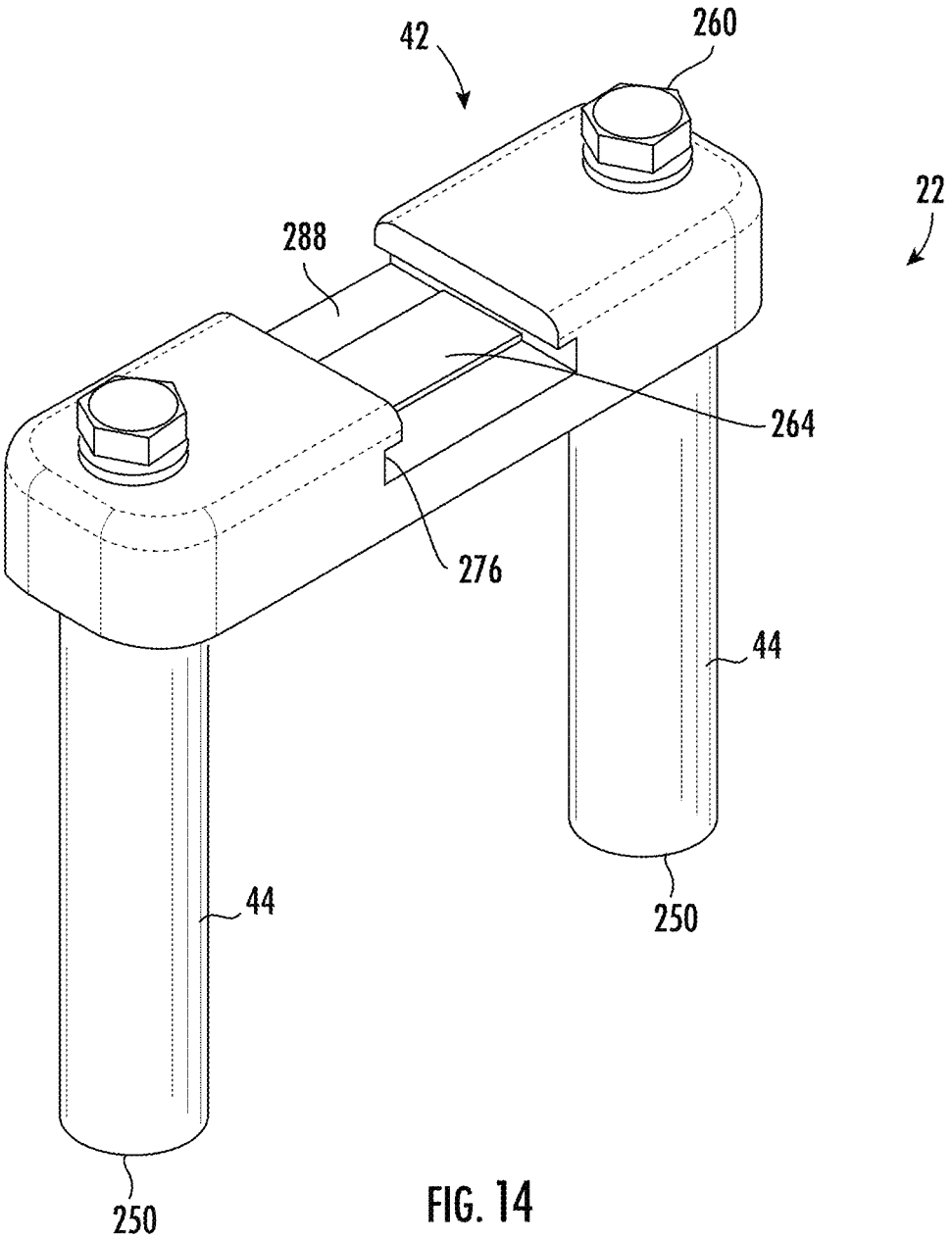
FIG. 14 is a perspective view of an inverted U-shaped mount in accordance with the present invention.
Figure 15:
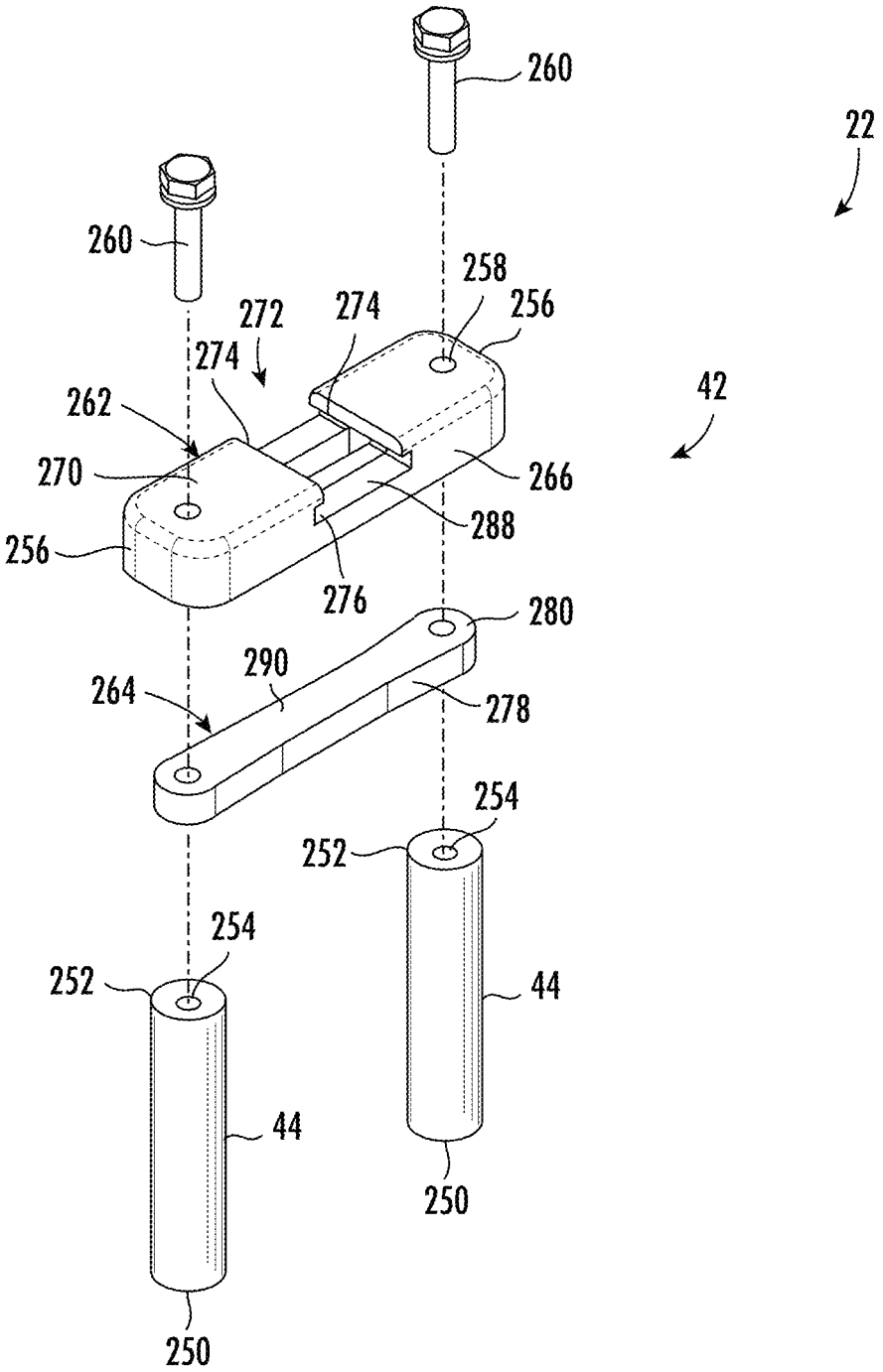
FIG. 15 is an exploded view of an inverted U-shaped mount in accordance with the present invention.
Figure 16:
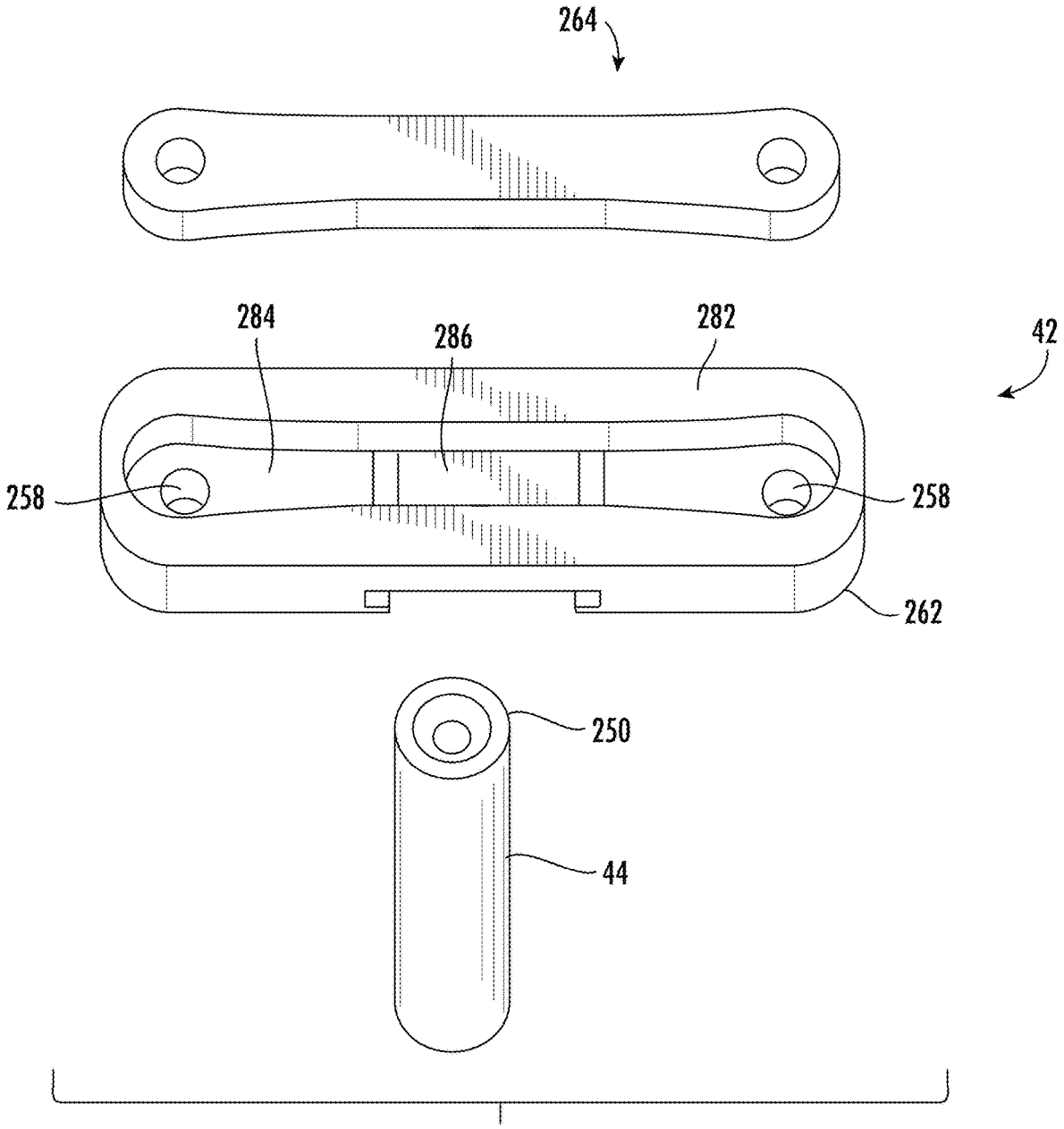
FIG. 16 shows a bottom exploded view of a portion of an inverted U-shaped mount in accordance with the present invention.

FIG. 13 is a cross section of the gassing rail assembly of FIG. 1 taken through the rail bridge, with the C-channel and mounting fixture omitted, and the rail bottom and rail top assembly modified per the embodiment of FIG. 7. FIG. 14 is a perspective view of an inverted U-shaped mount 22 in accordance with the present invention. FIG. 15 is an exploded view of an inverted U-shaped mount 22 in accordance with the present invention. FIG. 16 shows a bottom exploded view of a portion of an inverted U-shaped mount 22 in accordance with the present invention.

The inverted U-shaped mount 22 is shown including an upper bridge portion 42 and a pair of standoffs 44 extending downward from the upper bridge portion 42 forming lower ends 250. The lower ends 250 are secured to the top side of the rail bottom 114. The standoffs 44 include an upper end 252, the upper and lower ends 252 include an internally threaded opening 254. The upper bridge portion 42 having a first and second end 256. The ends of the bridge include openings 258 and are secured to respective upper end 252 of the standoff via a fastener 260 extending down through the opening 258 into the internally threaded opening 254 in the upper end 252 of the standoff 44. Each upper bridge portion 42 includes a rail bridge 262 and a clamp bar 264. The rail bridge 262 has longitudinally extending sides 266, a top surface 270 of the rail bridge includes a slot 272 extending across a mid-portion from one longitudinal side 266 to the other longitudinal side 266. The slot 272 includes sides 274 and each side includes an undercut 276. The clamp bar 264 having a longitudinally extending shape with longitudinal sides 278 and ends 280. A bottom surface 282 of the rail bridge 262 includes a recessed cutout 284 having the shape of the clamp bar 264, with the recessed cutout 284 extending into the area of the bridge portion openings 258. The recessed cutout 284 forms a clamp opening 286 extending between the undercuts 276, wherein the recessed cutout 284 extends upward above an upper surface 288 of the slot 272 and wherein with the clamp bar 264 received within the recessed cutout 284 in an uppermost position with respect to the rail bridge 262, an upper surface 290 of the clamp bar 264 extends above the upper surface 288 of the slot 272.

Figure 17:
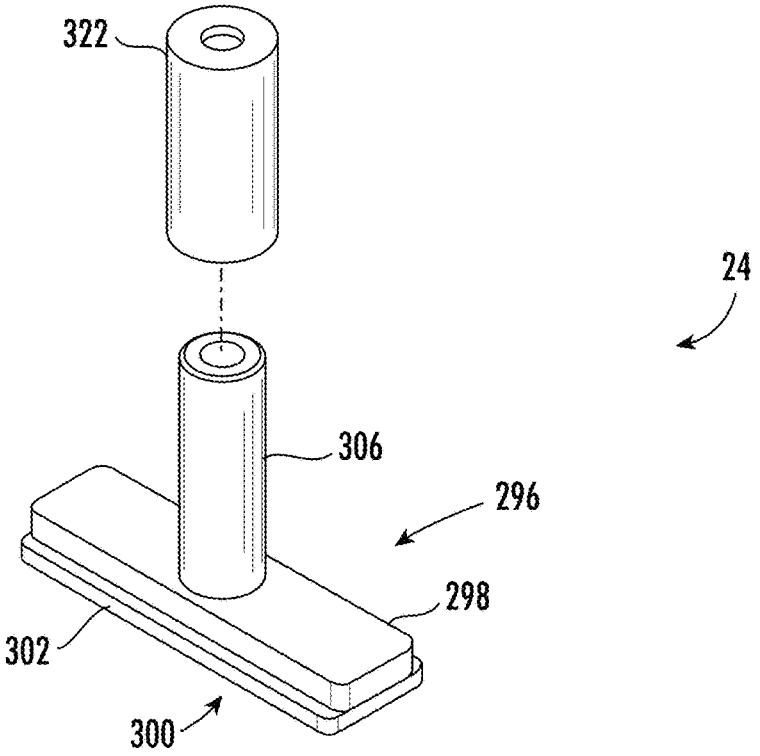
FIG. 17 shows a partial exploded view of a mounting fixture in accordance with the present invention.
Figure 18:
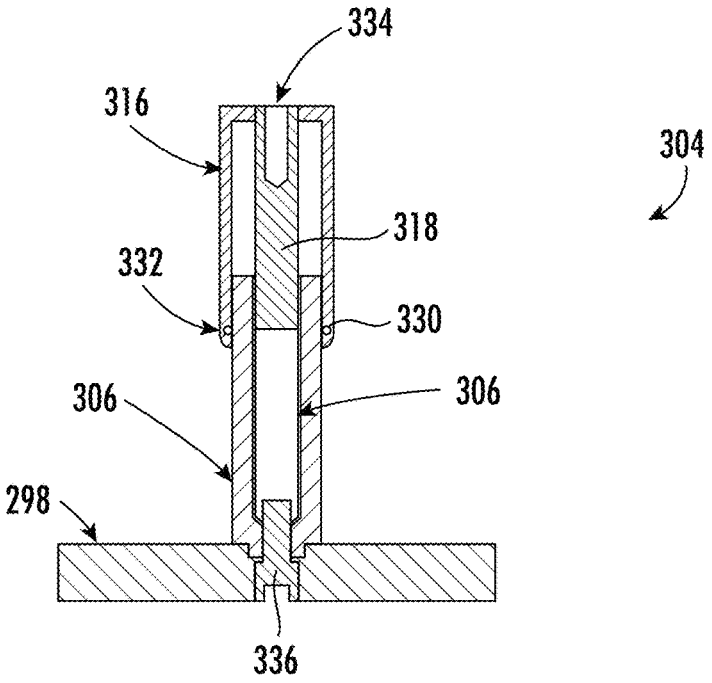
FIG. 18 is a cross sectional view of a mounting fixture in accordance with the present invention.
Figure 19:
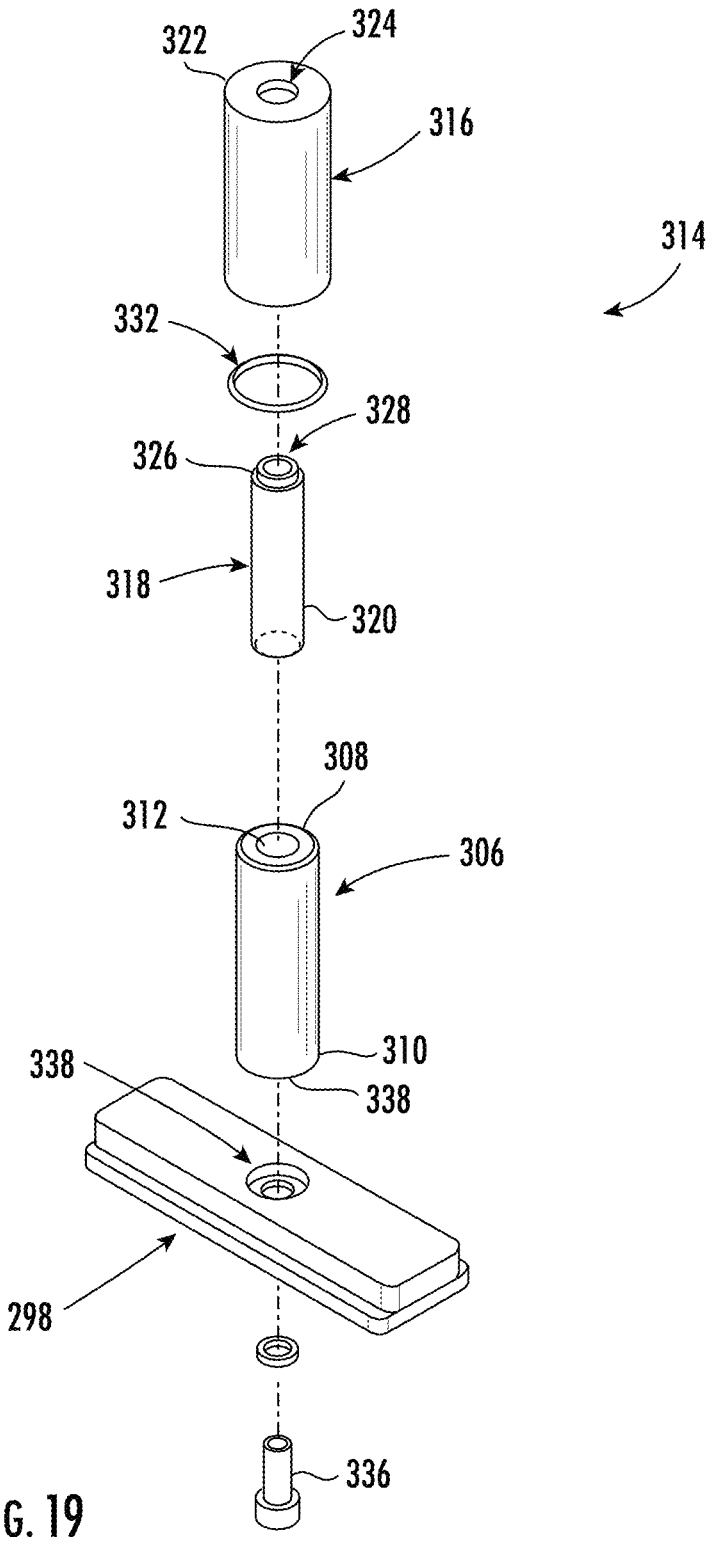
FIG. 19 is an exploded view of a mounting fixture in accordance with the present invention.

FIG. 17 shows a partial exploded view of a mounting fixture 24 in accordance with the present invention. FIG. 18 is a cross sectional view of a mounting fixture 24 in accordance with the present invention. FIG. 19 is an exploded view of a mounting fixture 24 in accordance with the present invention.

The mounting fixture 24 is adapted to depend from an overhead mounting structure. The mounting fixtures 24 include a lower end 296 having a slide bar 298. The slide bar 298 adapted to extend in a longitudinal direction at a right angle to the bridge portion 42. The slide bar 298 having longitudinal sides 300, each side having a ledge or foot 302 extending beyond the sides and in a longitudinal direction, whereby the slide bar 298 is adapted to be received by the rail bridge 262 in sliding engagement, and whereby tightening of the fasteners 260 extending through the ends 256 of the bridge portion 42 and upper ends 252 of the standoffs 44 clamps the second part of the sliding mechanism or slide bar 298 into a desired position relative to the first part of the sliding mechanism or inverted U-shaped mount 22.

The mounting fixtures 24 include a rail height adjustment assembly 304. The rail height adjustment assembly 304 includes a lower shaft 306 having an upper end 308, a lower end 310 and an internal thread 312, and an upper assembly 314 having an outside sleeve 316 and a rod 318 having an external threaded surface 320 for engagement with the internal thread 312 of the lower shaft 306, wherein the rod 318 is received by the outside sleeve 316. The upper end 322 of the outside sleeve 316 includes an oblong shaped opening 324, and the upper end 326 of the rod 318 includes an oblong shaped post 328 to be received in locking engagement with the oblong shaped opening 324, the internal surface of the lower end of the outside sleeve 316 includes an annular ring 330 having an O-ring 332, the upper end of the rod 318 includes a threaded opening 334 adapted to receive a fastener to be secured to the overhead mounting structure, the lower end of the shaft 306 is fixedly secured to the second part of the sliding mechanism or slide bar 298, such as via a fastener 336 and anti-rotation locking features 338.

The invention claimed is:

1. A gassing rail apparatus to be used in a food packaging conveyor system, the gassing rail apparatus adapted to be coupled to a gas source, comprising:

a rail top assembly, the rail top assembly including, a rail top, the rail top having an upper portion with at least one laminar flow port opening, and a lower portion includes a laminar flow channel, the laminar flow channel extends generally along a longitudinal axis, the laminar flow port opening coupled to the laminar flow channel, the longitudinal laminar flow channel is surrounded by an outer seat, the outer seat having a generally rectangular shape, a gas port coupled to the laminar flow port opening, the gas port is adapted for coupling to a gas source, a three layer element having a planar shape which extends generally along a longitudinally axis, the three layer element has an upper surface and a lower surface, the three layer element is received by the lower portion of the rail top, and a rail frame which extends along a longitudinal axis, the rail frame has an upper surface and a lower surface, at least one gas distribution slot extending along a longitudinal axis, the rail frame substantially planar with a downward depending flange extending from the at least one gas distribution slot, the rail frame is received by the outer seat; and a rail bottom located below the top rail, the rail bottom adapted to receive at least one rail top assembly, the rail bottom having at least one gas distribution opening corresponding to each rail top assembly, the at least one gas distribution opening extending along the longitudinal axis of the rail bottom, and is aligned with the laminar flow channel, the gas distribution opening receives a corresponding downward depending flange and aligns the rail top assembly and rail bottom.

2. The gassing rail apparatus of claim 1, wherein the three layer element comprises a top layer, middle layer and bottom layer, the top layer is a 5-ply element, the middle layer is a 5-ply element having at least one gas distribution opening, and the bottom layer is a 2-ply element.

3. The gassing rail apparatus of claim 1, wherein the rail top includes a plurality of through holes, the three layer element includes a plurality of through holes and the rail frame includes a plurality of through holes aligned with the through holes of the rail top and three layer element, and a plurality of fasteners secure the rail frame and three layer element to the rail top.

4. The gassing rail apparatus of claim 1, wherein the rail bottom receives two rail top assemblies, the rail bottom having two sets of three gas distribution openings, each set corresponding to one of the two rail top assemblies, each rail frame having three gas distribution slots, each middle layer having three gas distribution openings.

5. The gassing rail apparatus of claim 1, wherein the rail bottom includes two rotating locking arms per rail top assembly, wherein the rotating locking arms secure the rail top assembly to the rail bottom.

6. The gassing rail apparatus of claim 1, wherein the rail bottom includes two rail bridges.

7. The gassing rail apparatus of claim 6, further comprising a rail height adjustment coupled to each rail bridge and adapted to be coupled to an overhead C-channel support structure, wherein the rail height adjustment includes threaded concentric sleeves for adjusting the height of the rail bottom and rail top assembly.

8. The gassing rail apparatus of claim 7, wherein the rail height adjustment includes a slide bar, and the rail bridge includes slotted receiver for slidably receiving the slide bar, the rail bridge further including a clamp bar for clamping the slide bar in a desired position.

9. The gassing rail apparatus of claim 1, wherein the rail top is made of plastic and the port block and rail frame are made of aluminum or stainless steel.

10. The gassing rail apparatus of claim 9, wherein the rail top includes an inner seat located between the longitudinal laminar flow channel and the outer seat, the inner seat having a generally rectangular shape, wherein the three layer element is received by the inner seat.

11. The gassing rail apparatus of claim 1, wherein the upper portion of the rail top includes a first and second laminar flow port opening, the first and second laminar flow port openings coupled to the laminar flow channel, wherein the gas port includes a port block having a port fitting opening and a first and second port block outlets, the port block having a channel in fluid communication with the port fitting opening and the first and second port block outlets, wherein each of the port block outlets includes a recessed seat to receive a respective port block baffle and an O-ring located below the port block baffle, and the port block is secured to the upper portion of the rail top with the first and second port block openings aligned with a respective first and second laminar flow port openings, and the a port fitting opening receives a port fitting.

12. The gassing rail apparatus of claim 1, wherein the rail top, the port block and rail frame are made of stainless steel.

13. The gassing rail apparatus of claim 12, wherein the upper surface of the rail frame includes a recessed seat for receiving the three layer element, the rail frame and three layer element are welded together.

14. The gassing rail apparatus of claim 1, wherein the upper portion of the rail top includes a laminar flow port opening have an oval shape, wherein the oval shaped laminar flow port opening forms an inner recessed seat and an outer recessed seat, a single layer oval shaped baffle is received by the inner recessed seat, wherein the gas port includes a port block having a port fitting opening and an oval shaped port block outlet, the port block having a channel in fluid communication with the port fitting opening and the oval shaped port block outlet, wherein the oval shaped port block outlet includes a downward extending step which is received by the outer recessed seat of the rail top, and the port block is secured to the upper portion of the rail top with the oval shaped port block outlet aligned with the oval shaped laminar flow port opening, wherein the single layer oval shaped baffle is in direct contact with the inner seat of the rail top and the downward extending step of the port block, and the port fitting opening receives a port fitting.

* * * * *